US005078587A

United States Patent [19]

Bison

[11] Patent Number: 5,078,587

[45] Date of Patent: Jan. 7, 1992

[54] FORMING TOOL FOR FORMING PEG HOLES IN AN ANODE

[75] Inventor: Giovanni Bison, Mira, Italy

[73] Assignee: Alusuisse Italia SpA, Milan, Italy

[21] Appl. No.: 621,078

[22] Filed: Nov. 30, 1990

[30] Foreign Application Priority Data

Jul. 12, 1989 [DE] Fed. Rep. of Germany ..... 8914428

[51] Int. Cl.[5] ..... B29C 39/26

[52] U.S. Cl. ..... 425/468; 249/175; 425/78; 425/414; 425/457; 425/DIG. 10

[58] Field of Search ..... 425/78, DIG. 10, 412, 425/414, 418, 457, 468; 249/175

[56] References Cited

U.S. PATENT DOCUMENTS 716,343 12/1902 Locke ..... 425/418
1,379,328 5/1921 Baird ..... 425/418
4,268,003 5/1981 Liautaud ..... 425/DIG. 10
4,842,508 6/1989 Boskovic ..... 425/DIG. 10

*Primary Examiner*—Willard E. Hoag
*Attorney, Agent, or Firm*—Bachman & LaPointe

[57] ABSTRACT

A forming tool, used in the production of an anode before the firing, for forming peg holes with angularly grooved sidewalls, having a cap plate to which at least one retaining pivot, with one end attached and having a stop, which is fixed to the cap plate and limits the rotation of the forming body in one direction and an elastic means which on the one side is connected so as to be fixed to the cap plate and don the other side is connected to the forming body to preload the latter against the stop and ensure that its projections always form the grooves in the wall of the peg hole in the same angular position relative to the finished anode. As a result cleaning of the peg hole by an automatic cleaning machine is made possible.

3 Claims, 2 Drawing Sheets

FORMING TOOL FOR FORMING PEG HOLES IN AN ANODE

BACKGROUND OF THE INVENTION

The invention relates to a forming tool for forming peg holes in an anode during its production before firing.

During the production of anodes, the anode material is poured into a mold into which protrude forming bodies of generally known forming tools for forming the peg holes at specified positions. After the pouring and pressing of such a "green" anode, the forming tools must be withdrawn from the peg holes before the anode is fired. The sloping grooves formed in the wall of the peg hole by the projections of the respective forming body are retained when the forming tool is removed, since the forming body, with the projections on the outside, can rotate freely about the retaining pivot. After the removal of the forming tool, the respective angular position of the projections is indeterminate in-as-much as the forming body can rotate further even after release from the anode. When the forming tool is inserted into the mold for producing the next "green" anode, the projections are thus located in a different angular position relative to the wall of the peg hole of the "green" anode produced beforehand. This makes automatic cleaning of the grooves formed out in the anode by the projections more difficult after the firing of the anode.

SUMMARY OF THE INVENTION

The object of the invention is therefore to design the forming tool with means of simple design in such a way that its projections always form the grooves in the wall of the peg hole in the same angular position relative to the finished anode.

This object is achieved in accordance with the present invention. The present invention comprises a forming tool for forming peg holes in an anode during its production before the firing, which forming tool has a cap plate to which at least one retaining pivot, with one end, is attached in such a way as to be fixed in terms of rotation, on which retaining pivot an essentially cylindrical forming body is rotatably mounted, on whose outer wall projections having the same slope relative to the axis of the forming body are provided, characterized by a stop which is fixed to the cap plate and limits the rotation of the forming body in one direction, and by an elastic means which on the one side is connected so as to be fixed to the cap plate and on the other side is connected to the forming body and preloads the latter against the stop.

In accordance with advantageous further developments of the forming tool according to the invention, the forming tool is characterized in that the elastic means is a helical spring which is accommodated in an annular groove formed in the forming body, open towards the cap plate and formed concentrically to the retaining pivot. In addition, the forming tool is characterized in that, between the annular groove and the cap plate, a cover ring fixed to the cap plate is inserted into the forming body concentrically to the retaining pivot, in that the helical spring is connected on the one side to the cover ring and on the other side to the groove root of the annular groove, and in that the stop is formed by one end of a stop opening which is formed in the cover ring in the shape of a circular ring segment concentric to the retaining pivot and into which a stop pin fixed to the groove root engages.

The configuration, according to the invention, of the forming tool ensures that the forming body can rotate during withdrawal from the anode, the elastic means being loaded, but without the peg holes being damaged. After withdrawal from the anode, the forming body is then turned back by the loaded elastic means into its initial position in which it bears against the stop. Consequently, all grooves, formed by the projections of a forming body, in the wall of the peg holes of the anode are identically orientated in all anodes produced, so that the grooves can be automatically cleaned in a simple manner.

BRIEF DESCRIPTION OF THE DRAWINGS

An exemplary embodiment of the invention is described in greater detail below with reference to drawings, in which.

DETAILED DESCRIPTION

Figure 1:
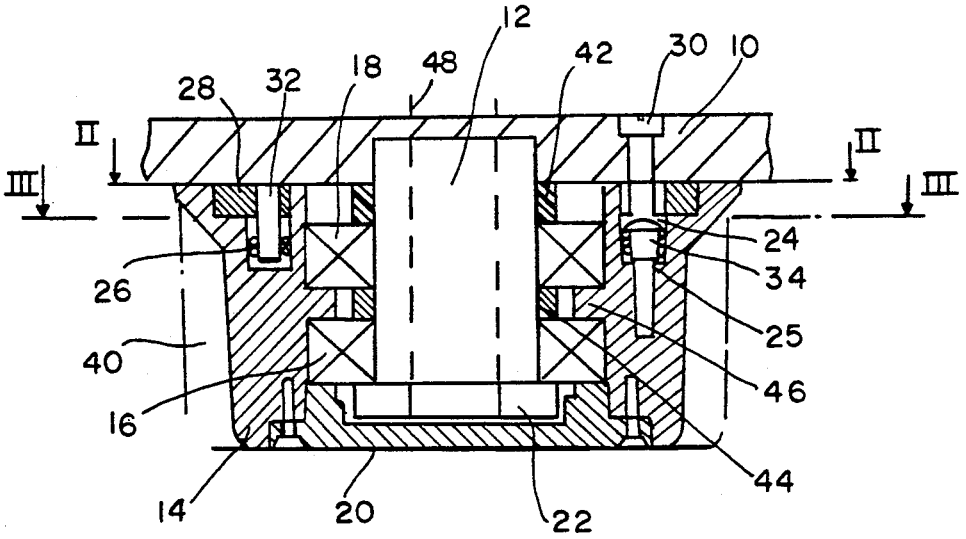
FIG. 1, in an axial section, shows the forming tool in its stop position.
Figure 2:
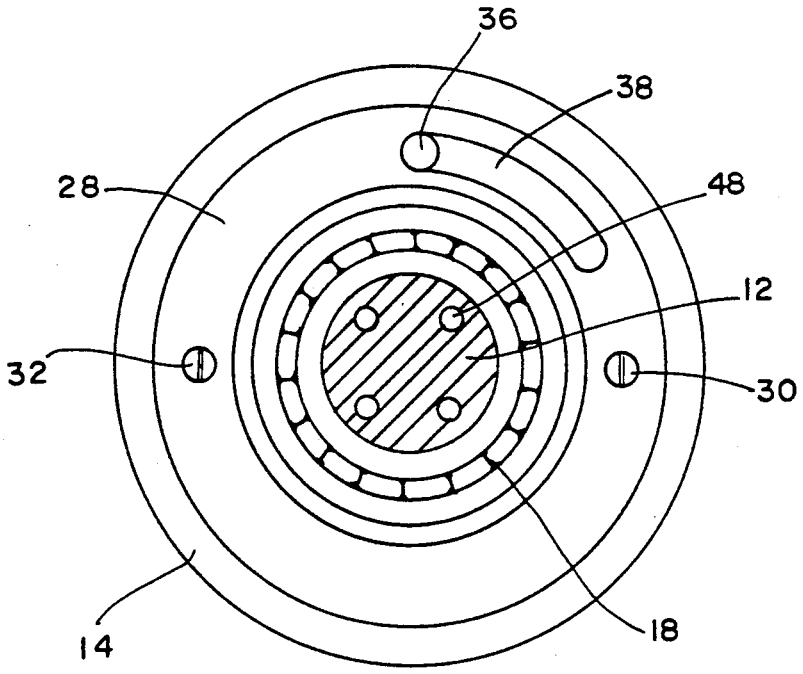
FIG. 2 shows the section II—II of FIG. 1.
Figure 3:
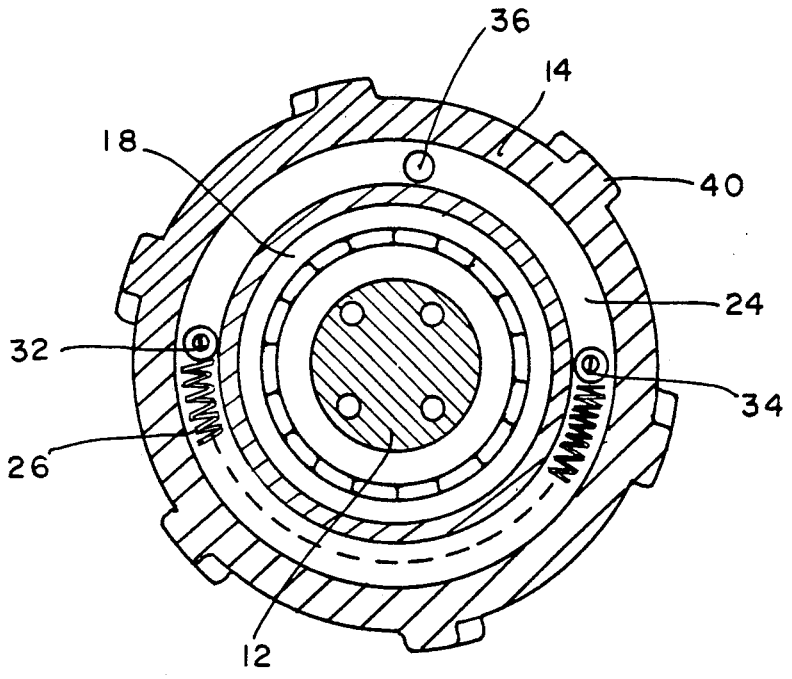
FIG. 3 shows the section III—III of FIG. 1.

The forming tool shown in FIGS. 1 to 3 has a cap plate 10 to which a retaining pivot 12, with one of its ends, is fixed by means of fixing screws 48 passing axially through the retaining pivot 12. An essentially cylindrical forming body 14 is rotatably mounted on the retaining pivot 12 by a top and bottom radial bearing 16 and 18 respectively. Tangential projections 40 having the same slope relative to the axis of the forming body 14 are provided on the outer wall of the forming body 14. The outer face of the bottom radial bearing 16 is held on the one side by an inwardly extending bearing projection 46 of the forming body 14 and on the other side by a bearing cap 20 screwed onto the forming body 14 on the side opposite the cap plate 10. The inner face of the bottom radial bearing 16 is supported on the one side on a distance ring 44 and on the other side on a bearing collar 22 provided at the bottom end of the retaining pivot 12. The inner face of the top radial bearing 18 is mounted in a fixed position on the one side by the distance ring 44 and on the other side by a distance sleeve 42 which presses with its other side against the cap plate 10. The outer face of the top radial bearing 18 rests on the bearing projection 46.

An annular groove 24 which is open at the top towards the cap plate 10 and is concentric to the retaining pivot 12 is formed in the forming body 14. Between the annular groove 24 and the cap plate 10, a cover ring 28 likewise concentric to the retaining pivot 12 is inserted into the forming body 14. The surface of the cover ring 28 is essentially flush with the surface of the forming body 14. The cover ring 28 is connected to the cap plate via a threaded stem 30 in such a way as to be fixed in terms of rotation. The cover ring 28 is dimensioned in such a way that the forming body 14 can rotate about the retaining pivot 12 and the cover ring 28 without becoming jammed with the latter.

A helical spring 26 is arranged in the annular groove 24 in such a way that its ends are diametrically opposite in the stop position of the forming body 14. One end of the helical spring 26 is connected via a grub screw 32 to the cover ring 28 fixed to the cap plate, while the other end of the helical spring 26 is connected to the forming body 14 via a stud bolt 34 screwed into the groove root 25 of the annular groove 24. A stop 38 is provided in the cover ring 28 in the area of the annular groove 24 diametrically opposite the helical spring 26, which stop 38 is formed by one end of a circular ring segment concentric to the retaining pivot 12. A stop pin 36 fixed to the groove root 25 of the annular groove 24 engages into the circular ring segment. The stop pin 36 is preloaded by the tensile force of the helical spring 26 against the circular-ring-segment end facing the grub screw 32. However, the forming body 14 can be rotated against the tensile direction of the helical spring 26 in such a way that the stop pin 36 fixed to the forming body 14 moves in the direction of the circular-segment end opposite the stop 38, i.e. to the right in FIG. 2.

During the pressing of a "green" anode, the forming tool is inserted into a mold, the mold being closed at the top by the cap plate 10. After the press operation, the cap plate 10 is lifted up together with the forming body 14. On account of the projections 40 running at a slope on the peripheral wall of the forming body 14 relative to its axis, the forming body 14, guided by the grooves, which have become dimensionally stable during the pressing, is rotated against the direction of the tensile force of the helical spring 26, which is thereby loaded further. As soon as the projections 40 of the forming body 14 are no longer in contact with the grooves when the forming body 14 is withdrawn from the anode, the forming body 14 is turned back by the preloaded helical spring 26 until the stop pin 36 bears against the circular-segment end facing the grub screw 32, i.e. against the stop 38. The forming body 14 is now again located in its stop position in which the projections 40 have exactly the same angular position relative to the new anode to be pressed as in the anode finished beforehand before the firing.

The helical spring 26 is designed to have such a tensile force that the grooves of the peg hole, formed by the forming body 14, are not damaged when the forming body 14 is withdrawn from the anode, and the forming body 14 is rotated into its stop position after withdrawal from the anode.

The exemplary embodiment has been described with reference to one forming body 14. During the production of anodes, however, it is usual to provide at least two peg holes which are formed in the manner described above by identical forming bodies 14 rotatably fixed to the cap plate.

What is claimed is:

1. Forming tool for forming peg holes in an anode during its production before the firing, which comprises:

a cap plate;

at least one retaining pivot attached to the cap plate in such a way as to be fixed in terms of rotation;

an essentially cylindrical forming body rotatably mounted on the retaining pivot, said forming body having outer wall projections having the same slope relative to the axis of the forming body;

a stop which is fixed to the cap plate and limits the rotation of the forming body in one direction; and an elastic means which on one side is connected so as to be fixed to the cap plate and on the other side is connected to the forming body and preloads the latter against the stop.

2. Forming tool according to claim 1, wherein the elastic means is a helical spring which is accommodated in an annular groove formed in the forming body, open towards the cap plate and formed concentrically to the retaining pivot.

3. Forming tool according to claim 2, wherein between the annular groove and the cap plate, a cover ring fixed to the cap plate is inserted into the forming body concentrically to the retaining pivot, in that the helical spring is connected on the one side to the cover ring and on the other side to a groove root of the annular groove, and in that the stop is formed by one end of a stop opening which is formed in the cover ring in the shape of a circular ring segment concentric to the retaining pivot and into which a stop pin fixed to the groove root engages.

* * * * *